US005198790A

United States Patent [19]

Elow

[11] Patent Number: 5,198,790

[45] Date of Patent: Mar. 30, 1993

[54] ELECTRICAL TRANSDUCER

[75] Inventor: David I. Elow, Owosso, Mich.

[73] Assignee: Toledo Commutator Co., Owosso, Mich.

[21] Appl. No.: 874,508

[22] Filed: Apr. 27, 1992

[51] Int. Cl.[5] ..... H01F 15/02; H01F 27/26

[52] U.S. Cl. ..... 336/83; 336/98; 336/210; 336/212; 336/233

[58] Field of Search ..... 336/83, 210, 212, 65, 336/233, 234, 98

[56] References Cited

U.S. PATENT DOCUMENTS

| | | | |
|---|---|---|---|
| 1,367,957 | 2/1921 | Garretson | 336/83 |
| 1,815,380 | 7/1931 | Ponter et al. | 336/83 |
| 2,801,293 | 7/1957 | Howell et al. | 336/83 |
| 3,358,256 | 12/1967 | Naito et al. | 336/83 |
| 3,371,301 | 2/1968 | Hisano | 336/83 |
| 3,750,069 | 7/1973 | Renskers | 336/212 |
| 3,876,928 | 4/1975 | Wheeler et al. | 336/83 |
| 4,656,450 | 4/1987 | Jarosz et al. | 336/83 |

*Primary Examiner*—Thomas J. Kozma

*Attorney, Agent, or Firm*—Gifford, Groh, Sprinkle, Patmore and Anderson

[57] ABSTRACT

A transducer is disclosed for detecting an electrical pulse from a circuit and for generating an output signal in response to each pulse. The transducer includes a first electric coil having two ends adapted for connection with the circuit and a second electric coil having two ends on which the output signal is generated. The coils are coaxially wound together and a rod constructed of a ferromagnetic material is positioned through the rod. A housing also constructed of a ferromagnetic material includes two spaced end portions which contact the opposite ends of the rod. The housing also includes locking tabs which engage and lock the housing to opposite ends of the rod.

5 Claims, 1 Drawing Sheet

ELECTRICAL TRANSDUCER

BACKGROUND OF THE INVENTION

I. Field of the Invention

The present invention relates generally to electrical transducers and, more particularly, to such a transducer for detecting an electrical output pulse from a circuit.

II. Description of the Prior Art

There are many previously known electrical transducers which detect output pulses from an electric circuit. Furthermore, many of these previously known transducers provide an output signal which varies in magnitude in proportion with the magnitude of the electrical pulse detected.

A primary disadvantage of these previously known transducers is that they are relatively expensive to manufacture and thus add significantly to the overall costs of the electronic circuit. This is particularly true when a transducer is used to detect the electrical pulses from an electric motor during motor starting. Because of the high costs involved with such transducers, they have not enjoyed widespread use or acceptance in such applications.

In many such applications, however, high accuracy from the transducer is simply not required since only the occurrence of a pulse from the electric circuit, rather than its magnitude, is necessary to implement the desired electronic function.

SUMMARY OF THE PRESENT INVENTION

The present invention provides a very simple and inexpensive transducer which detects electrical pulses from a circuit and which overcomes the disadvantages of the previously known devices.

In brief, the transducer of the present invention comprises a first electric coil having two ends which are adapted for connection with a circuit from which detection of electrical pulses are desired. A second electric coil is coaxially wound about the first coil and this second coil has two ends which provide the output signal from the transducer.

A rod constructed of a ferromagnetic material, such as steel, is positioned through the coaxial coils so that the ends of the rod protrude outwardly from the ends of the coil. A one piece housing has two portions which contact the opposite ends of the rod to complete the magnetic circuit through the rod. This housing is of a one piece construction and includes inwardly protruding locking tabs which snappingly engage and support the opposite ends of the rod thus completing the assembly of the transducer.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
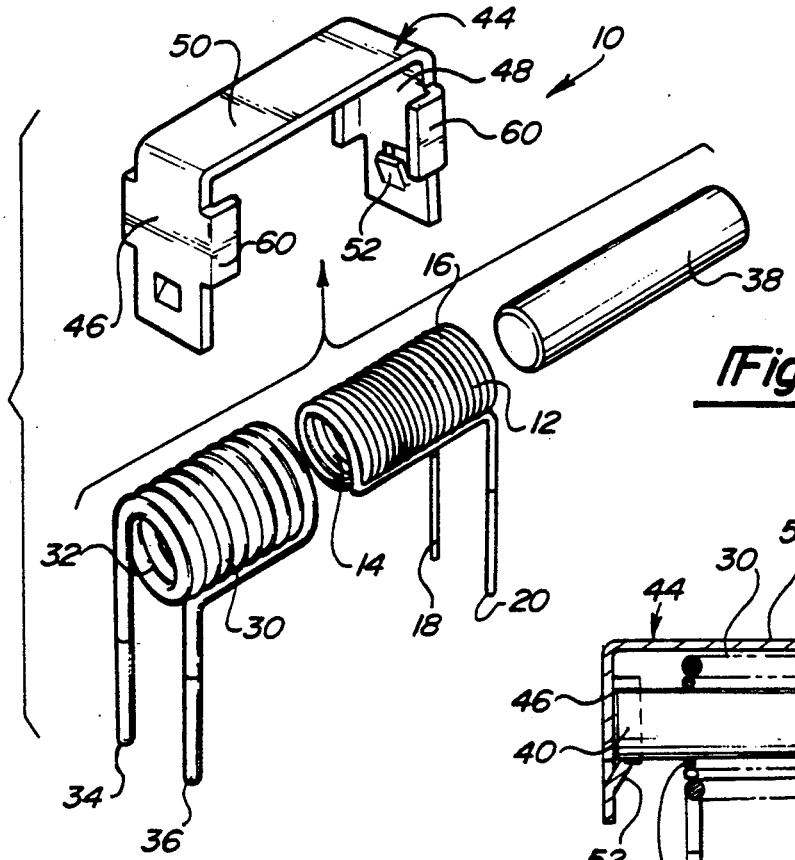
FIG. 1 is an exploded view illustrating a preferred embodiment of the present invention.
Figure 2:
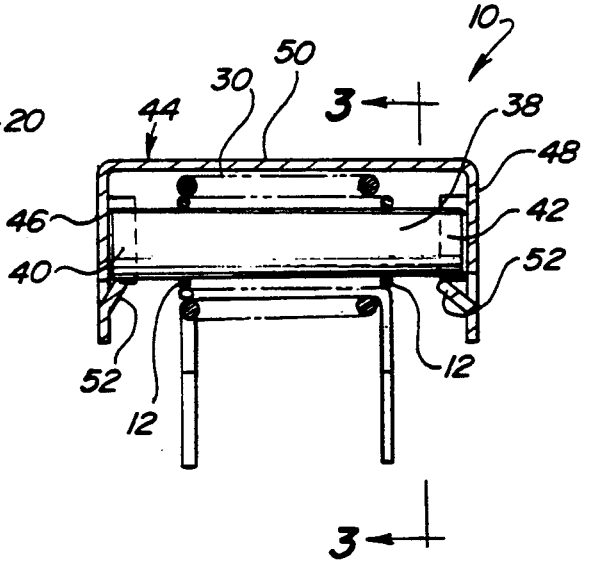
FIG. 2 is a longitudinal partial sectional view illustrating the assembled transducer of the present invention.

With reference first to FIGS. 1 and 2, a preferred embodiment of the transducer 10 of the present invention is thereshown and comprises a first electric coil 12. The electric coil 12 is constructed from electric wire having a predetermined number of turns with a generally circular inner periphery 14 and, likewise, a circular outer periphery 16. The wire which forms the electric coil 12 is covered with an electrical insulating material or coating to prevent shorting of the coil 12.

The electric coil 12 further includes two ends 18 and 20 which are adapted for connection with the electric circuit (not shown) from which the detection of electrical pulses are desired. In one application, the coil ends 18 and 20 are connected with the starter circuit of an electric motor when the transducer 10 is used in the start control circuitry of the electric motor.

Still referring to FIGS. 1 and 2, the transducer 10 includes a second electric coil 30 having a predetermined number of turns of electric wire which are wound such that an inner periphery 32 of the coil 30 is generally circular in shape. Furthermore, as best shown in FIG. 2, the inner periphery 32 of the second coil 30 has a diameter greater than the outer diameter of the first coil 12 so that the coils 12 and 30 are coaxially wound together.

The wire which forms the second coil 30 is, like the first coil 12, coated with an electrical insulating material. The second coil 30 also includes two ends 34 and 36 which provide the output signal from the transducer 10.

An elongated rod 38 constructed of a ferroelectric material, such as steel, is positioned axially through the coils 12 and 30. Furthermore, as best shown in FIG. 2, the rod 38 is dimensioned so that the ends 40 and 42 of the rod protrude axially outwardly from the respective ends of the coils 12 and 30.

The transducer 10 further includes a housing 44 which is generally U-shaped and thus has two spaced apart and generally parallel side legs 46 and 48 and an intermediate leg 50 which joins the side legs 46 and 48 together.

As best shown in FIG. 2, portions of the side legs 46 and 48 contact the opposite ends 40 and 42, respectively, of the rod 38. In doing so, the housing 44 completes the magnetic circuit through the rod 38 thereby enhancing the magnetic coupling of the coils 12 and 30.

In order to connect the housing 44 to the rod 38, each side leg 46 and 48 of the housing includes an upwardly and inwardly extending locking tab 52. The locking tabs 52 are dimensioned to engage an underside of the rod 38, as best shown in FIG. 2, and, in doing so, entrap the ends 40 and 42 of the rod 38 between the locking tabs 52 and the intermediate housing leg 50. Further, in order to facilitate the assembly of the housing 44 to the rod 38, the housing 50 is sufficiently resilient so that, when the housing 50 is forced over the rod 38, the side walls 46 and 48 of the housing 50 flex outwardly as the locking tabs 52 pass over the ends 40 and 42 of the rod 38. Once the locking tabs 52 reach the lower portion of the rod 38, as viewed in FIG. 2, the housing 50 returns to its initial shape so that the locking tabs 52 engage the lower portion of the rod 38 in the previously described fashion.

Figure 3:
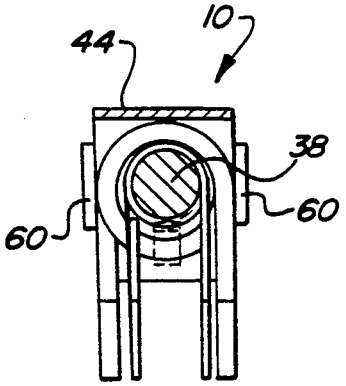
FIG. 3 is a cross sectional view taken substantially along line 3—3 in FIG. 2.

As best shown in FIGS. 1 and 3, in order to prevent lateral movement of the rod 38 with respect to the housing 50, each side leg 46 and 48 of the housing 50 includes a pair of side flaps 60. These side flaps 60 are dimensioned so that, with the housing 50 assembled to the rod 38, a portion of the ends 40 and 42 of the rod 38 are entrapped between the side flaps 60 which, together with the locking tabs 52 securely attach the rod 38 to the housing 50.

The entire housing 50, together with the locking tabs 52 and side flaps 60, is preferably of a one piece construction and preferably comprises a metal stamping. As such, the entire housing 50 can be very inexpensively constructed and, similarly, inexpensively assembled to the rod 38 with its mounted coils 12 and 30.

In operation, electrical pulses which are provided to the input ends 18 and 20 of the first coil 12 create an electromagnetic field in the well known manner. This, in turn, includes a magnetic field in the second coil 30 which converts the magnetic field to an output pulse at its output ends 34 and 36.

One application for the transducer 10 of the present invention is to detect the current phase of both the starter and the main windings of an electric motor by using two transducers 10. The outputs from the transducers 10 are then used by the starter motor control circuitry to disconnect the starter winding at the optimal time.

Having described my invention, however, many modifications thereto will become apparent to those skilled in the art to which it pertains without deviation from the spirit of the invention as defined by the scope of the appended claims.

I claim:

1. A transducer for detecting an electrical pulse from a circuit and for generating an output signal in response to each pulse comprising:

a first electric coil having two ends adapted for connection with the circuit, a second electric coil having two ends on which said output signal is generated, a rod constructed of a ferromagnetic material, said rod extending through said coils, a housing constructed of a ferromagnetic material, said housing having two spaced portions which contact opposite ends of said rod, said housing is generally U-shaped having spaced apart and generally parallel side legs and an intermediate leg, said rod contracting portions being provided on said side legs, means integral with said housing for attaching said housing and said rod together, and wherein said attaching means comprises a tab formed on each side leg, said tabs facing towards each other, each tab entrapping its respective end of said rod between said tab and said intermediate leg.

2. The invention as defined in claim 1 wherein said housing further comprises a pair of side flaps formed on each housing side leg, said flaps on each side leg entrapping a respective end of the rod therebetween.

3. The invention as defined in claim 2 wherein said housing is of a one piece construction.

4. The invention as defined in claim 1 wherein said coils are coaxially wound together.

5. The invention as defined in claim 1 wherein said tabs are angled upwardly and inwardly from a free end of their respective side legs towards said intermediate leg. e

* * * * *